United States Patent [19]

Eriksson et al.

[11] Patent Number: 4,541,472

[45] Date of Patent: Sep. 17, 1985

[54] SYSTEM FOR STIRRING IN CONTINUOUS CASTING

[75] Inventors: Jan Erik Eriksson, Helsingborg; Mats Karlsson, Hjarnarp; Sten Kollberg, Västerås; Bengt Mansson, Helsingborg, all of Sweden

[73] Assignee: ASEA Aktiebolag, Västerås, Sweden

[21] Appl. No.: 530,003

[22] Filed: Sep. 7, 1983

[30] Foreign Application Priority Data

Sep. 14, 1982 [SE] Sweden ..... 8205237

[51] Int. Cl.[4] ..... B22D 27/02; B22D 11/124

[52] U.S. Cl. ..... 164/504; 164/468; 164/444

[58] Field of Search ..... 164/466, 467, 468, 502, 164/503, 504, 147.1, 498, 499, 500, 443, 444, 485, 486, 487, 348; 335/300, 301; 366/273, 274; 266/234; 148/108

[56] References Cited

U.S. PATENT DOCUMENTS 4,378,548 3/1983 Rybak ..... 335/300 X

*Primary Examiner*—Kuang Y. Lin

*Attorney, Agent, or Firm*—Kenyon & Kenyon

[57] ABSTRACT

A system for stirring in continuous casting is formed by an inductive stirrer which inductively stirs molten metal in a continuously cast strand and at least one set of two water-cooling pipes positioned in front of the stirrer and having nozzles which eject water cooling-sprays against the strand. The two pipes have ends extending beyond the field and between their ends are electrically isolated from each other and the stirrer. By electrically interconnecting these ends outside of the field, the two pipes form a closed electric loop in which currents induced by the stirrers field cancel so that the net current flow is zero and the stirrer's field is not shielded from the strand.

4 Claims, 6 Drawing Figures

SYSTEM FOR STIRRING IN CONTINUOUS CASTING

In continuous casting when starting a plug of solidified metal closes the open bottom of a continuous casting mold having an open top into which molten metal is poured, the mold being cooled so as to form a skin of solidified metal. The plug forms a cold front and the skin containing unsolidified metal follows it through the mold's open bottom, downwardly in the form of a strand which travels continuously as molten metal is continuously poured into the top of the mold.

The unsolidified metal in the strand is stirred by a multiphase inductive stirrer positioned opposite and relatively close to the strand so that the stirrer incidently receives heat radiated from the strand, and to hasten complete solidification of the unsolidified metal in the strand is sprayed by jets of water. The stirrer obstructs the water jets so that opposite to that there is no water jet cooling of the strand. The stirrer itself is normally encased by a water cooled casing.

It is desirable to also spray the portion of the strand traveling in front of the stirrer and one way to do this is by positioning water-cooling pipes transversely in front of the stirrer and having nozzles which eject water cooling sprays forwardly towards and against the strand stirred by the stirrer. The water-cooling pipes do not require much space and can be positioned between the front or face of the stirrer and the strand.

However, with the above arrangement the pipes are directly in the traveling multiphase magnetic field projected by the stirrer and intended to go through the skin of the strand and into the molten metal within the skin so as to effect the stirring. Because the pipes are within this field circulating currents are induced in the pipes, which consequently screen off the stirrer's field from the strand. Conventionally, such water-cooling pipes eject their sprays through nozzles projecting radially from the outsides of the pipes, and this presents an additional problem in that when at the start of the continuous casting operation the cold front descends it sometimes deviates from its intended traveling direction, and in case the cold front hits the projecting nozzles they can be damaged so that the desired water cooling of the strand opposite the stirrer is terminated or at least is not fully effective.

According to the present invention such water-cooling pipes positioned transversely in front of the stirrer and having the nozzles adapted to eject water-cooling sprays forwardly towards the strand stirred by the stirrer, are arranged to form at least one set or system of two water-cooling pipes positioned side-by-side transversely in front of the stirrer. The two pipes are therefore directly in the magnetic stirring field projected from the front of the stirrer. The two pipes have ends extended transversely beyond the stirrer's field and are electrically isolated from each other and the stirrer throughout the portions of the pipes between these ends. These ends are electrically interconnected beyond the stirrers field so as to form the two pipes into a closed electric loop. In this way the net flow of currents in the pipes is zero and the pipes do not screen off the stirrer's field at least to any substantial degree. A plurality of these sets of pipes can be used.

Furthermore, to prevent nozzle damage in the event of a wandering cold front the sides of the pipes facing the strand are made with recesses in which the nozzles are installed with their front ends at least slightly below the surfaces of the pipes. In this way the nozzles are shielded from mechanical damage. The pipes themselves can be made strong enough to resist their displacement.

The invention includes other details which will become apparent from the following more detailed disclosure which is aided by the accompanying drawings in which:

FIG. 1 is a side view showing the strand descending past the stirrer and with the water-cooling pipes in operation.

FIG. 1*a* is a schematic drawing showing the relationship among the stirrer, a water-cooling pipe and the strand.

FIG. 2 is a schematic drawing showing the front of the stirrer and the two water-cooling pipes with their electrically interconnected projecting ends.

FIG. 2*a* is a schematic drawing showing the relationship between a water-cooling pipe and the strand.

In these drawings the stirrer 1 is shown with its field-projecting front facing the strand 2 so as to inductively stir molten metal in this strand which has just been continuously cast by means of the usual mold (not shown). The molten metal in this continuously cast strand has not completely solidified and is to be inductively stirred by the stirrer. One set of the two water-cooling pipes 3 are positioned side-by-side transversely in front of the stirrer between it and the strand and have the nozzles 4 which are adapted to eject water-cooling sprays forwardly towards the strand 2 being stirred by the field formed by the stirrer. The two pipes have ends 3*a* extending beyond the field of the stirrer, the pipes otherwise being necessarily in the stirrer's field. The pipes are supplied with pressurized water as indicated by the arrow W in FIG. 1.

Figure 1:
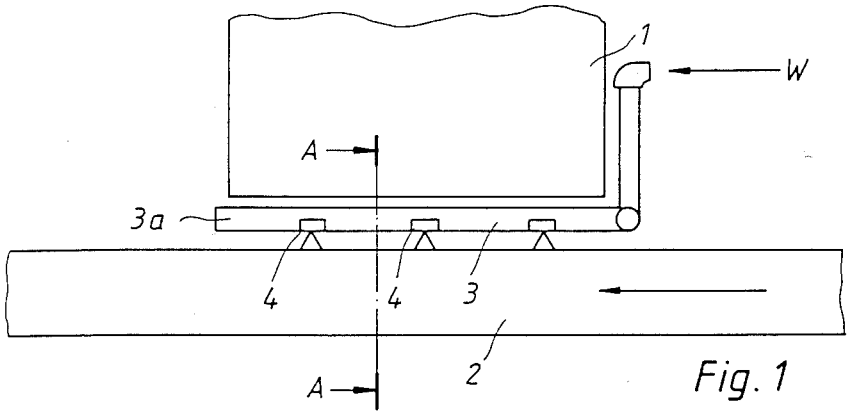
Figure 2:
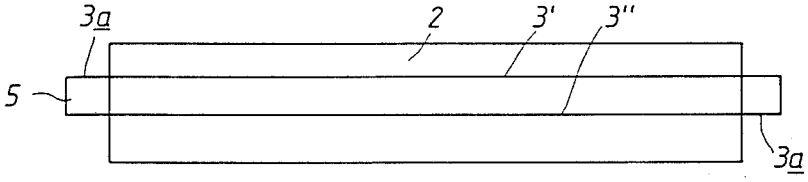
Figure 2A:
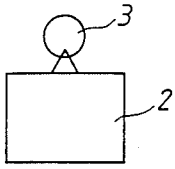
Figure 1A:
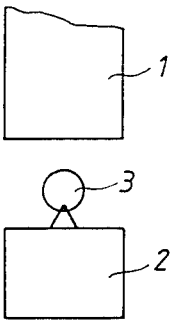

In FIG. 1 only one of the pipes 3 can be seen, the other pipe being behind the one shown. In FIG. 2, which is entirely schematic, the front of the stirrer 2 is shown with the two pipes 3' and 3'' being shown as arranged side-by-side and parallel to each other. The projecting ends 3*a* of these two pipes are electrically interconnected as indicated at 5 so as to form the closed electric loop in which the net flow of current induced by the stirrer's field is zero or substantially zero. Consequently, the two pipes do not interfere with or shield the stirrer's field from the strand, at least to any significant degree.

The two pipes must of course be made of metal and as a further precaution are preferably made of a non-magnetic metal of high electric resistance. For example, the pipes can be made from austenitic stainless steel.

It is possible to permit the pipes to directly contact the face of the stirrer without obtaining circulating currents, by coating the tubes at least on their sides contacting the stirrer with aluminum oxide or the like so as to provide electric insulation with adequate refractory characteristics.

Figure 3:
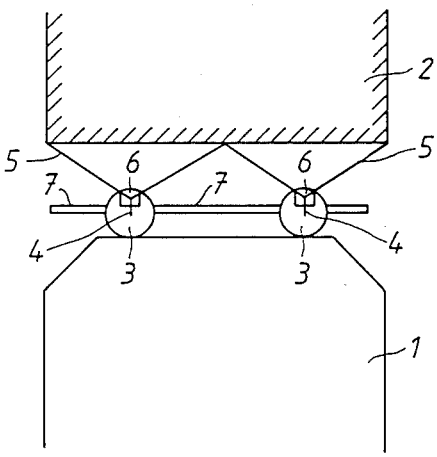
FIG. 3 is a cross section taken on the line A—A in FIG. 1.

In FIG. 1 the nozzles 4 are not shown other than to indicate their locations, but in FIG. 3 the nozzles 4 as indicated by the vertical lines 4 are installed in the bottoms of recesses 6 formed in the sides of the pipes facing the strand. These nozzles can be conventional but should not project beyond the outside surfaces of the pipes 3. By positioning the nozzles in these recesses the nozzles are mechanically protected. The design should be such as not to interfere with the outwardly diverging water sprays S ejected by the nozzles 3, the nozzle design preferably providing sprays which contact the entire side of the strand 2 opposite the stirrer.

In FIG. 1 the portions of the pipe 3 spanning the front of the stirrer 1 are shown as being spaced from the stirrer so as to be electrically isolated from the stirrer when the pipes are appropriately mounted and because the two pipes are laterally interspaced with respect to each other, they are electrically isolated from each other. In FIG. 3 the pipes are shown as being in contact with the front of the stirrer 1 and should therefore be provided with the aluminum oxide electric insulation between the pipes and the stirrers front, as previously mentioned. Such insulation is not shown in FIG. 3 because of the small scale of the figure.

The strand faced by the stirrer can now be supplied with large volumes of cooling water, and its heat radiation to the stirrer 1 is deminished. Although the stirrer 1 as conventionally manufactured is encased by a water-cooling jacket, further thermal protection is considered redundant but desireable. Therefore, in accordance with this invention, a flat refractory shield 7 is positioned in front of the stirrer and behind the pipes' nozzles and so as to thermally shield the stirrer. Being electrically non-conductive the shield 7 can be mounted by the pipes 3 as indicated in FIG. 3. The shield can be a flat plate of felted asbestos fibers or the like. It must remain electrically non-conductive when wet by water splashed backwardly by the strand's surface or the incidental steam. Although not shown, when the stirrer 1 is encased by the usual hollow walls through which cooling water is forced under pressure, these walls can be connected by suitable plumbing to supply the pipes 3 with the water they require.

However, there is an advantage in providing a separate water supply for the pipes 3 because then if the pipes' water sprays should cease as might occur through mechanical damage to the necessary plumbing, the normal water cooling of the stirrer 1 would continue and the stirrer would not be put out of operation.

Figure 4:
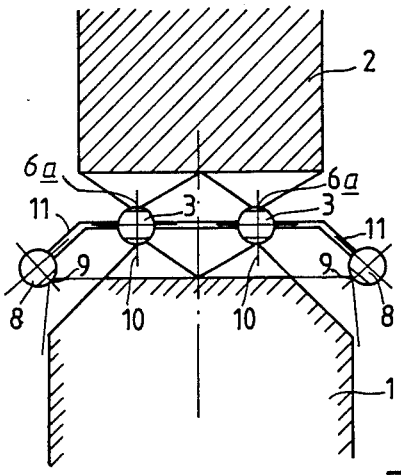
FIG. 4 is similar to FIG. 3 but shows a modification.

In the modification shown by FIG. 4 the cooling tubes 3 between the cast strand 2 and the stirrer 1 are shown with their recesses and nozzles indicated collectively by the numerals 6*a*. Outside of the field of the stirrer 1 two additional cooling pipes 8 are shown having nozzles 9, which may also be recessed, pointing towards the corners formed between the stirrer's face and its sides, and the pipes 3 are spaced from the front of the stirrer and are additionally provided with nozzles 10, pointing towards the front of the stirrer 1. In addition, the radiation protection shield referred to is shown at 11 as being in this case extending transversely and angled towards the stirrer 1 so as to provide protection for the stirrer's corners.

Keeping in mind that assuming the stirrer 1 is the standard type having a water cooled encasement, the system shown by FIG. 4 provides maximum possible protection. The strand 2 is sprayed in its area normally shielded by the stirrer 1 against the water spray cooling normally extending for a substantial length of the strand in conventional continuous casting equipment. The stirrer is well protected against radiation from the strand by the shield 11 which incidently can be constructed of the material described in connection with the description of the shield 7 in FIG. 3. In addition, the sprays from the nozzles 10 eject directly against the front or face of the stirrer 1 while the sprays 9 cool the stirrer's corners.

The manner in which the various pipes are mechanically supported is not illustrated or described because it is well within the skill of the art. The only requirement is that the lengths of the pipes within the field of the stirrer should be electrically isolated from each other and the front of the stirrer so as to form the electrically conductive loop resulting when the pipes projecting ends are electrically interconnected as indicated by FIG. 2. This is necessary for the currents induced in the set of tubes to cancel so that the net current flow is substantially zero and the stirrer's field is not shielded from the strand.

What is claimed is:

1. A system for stirring in continuous casting forming a traveling continuously cast strand having a skin containing unsolidified metal, comprising a multiphase stirrer positioned opposite to the strand and having a front facing the strand and forming a space between the front and the strand, said stirrer projecting a field from said front through said skin and into said unsolidified metal and stirring said unsolidified metal, said front receiving heat from said strand, at least one set of two water cooling pipes positioned in said space side-by-side transversely in front of the stirrer's said front between said front and said strand, said pipes being electrically isolated from each other and said front, said pipes being in said field and having circulating currents induced therein by said field, both of said pipes having ends projecting transversely beyond said field on both sides of said field and means for electrically interconnecting said ends and forming said two pipes into a closed electric loop in which the net flow of said currents is zero and do not interfere with said field, said pipes having means for supplying them with pressurized water and said pipes having nozzles pointing towards said strand and ejecting cooling water against said skin and cooling the skin as said strand travels opposite to said stirrer.

2. The system of claim 1 in which said pipes are made of non-magnetic metal and have recesses in which said nozzles are positioned and mechanically protected from damage by said strand.

3. The system of claim 1 in which a refractory shield of electrically non-conductive material is positioned in front of the stirrer behind the pipe's nozzles and so as to thermally shield the stirrer.

4. The system of claim 3 in which the shield extends flatly over the front of the stirrer and then angles over the corners of the stirrer.

* * * * *